US007543542B2

(12) United States Patent
Jakobsson

(10) Patent No.: US 7,543,542 B2
(45) Date of Patent: Jun. 9, 2009

(54) DEVICE FOR LANDING A CRAFT

(76) Inventor: Mikael Jakobsson, c/o Paul Kamins, 1551, Sleepy Hollow Loop, Grants Pass, OR (US) 97527

( * ) Notice: Subject to any disclaimer, the term of this patent is extended or adjusted under 35 U.S.C. 154(b) by 0 days.

(21) Appl. No.: 11/578,548

(22) PCT Filed: Apr. 13, 2005

(86) PCT No.: PCT/SE2005/000527

§ 371 (c)(1),
(2), (4) Date: Feb. 9, 2007

(87) PCT Pub. No.: WO2005/100145

PCT Pub. Date: Oct. 27, 2005

(65) Prior Publication Data

US 2007/0199500 A1 Aug. 30, 2007

(30) Foreign Application Priority Data

Apr. 16, 2004 (SE) ..... 0400999

(51) Int. Cl.
*B63B 21/00* (2006.01)
*B63B 17/00* (2006.01)

(52) U.S. Cl. ..... 114/230.1; 114/343

(58) Field of Classification Search ..... 114/230.1
See application file for complete search history.

(56) References Cited

U.S. PATENT DOCUMENTS

| | | | | |
|---|---|---|---|---|
| 2,754,792 | A | 7/1956 | Baird | |
| 3,177,839 | A * | 4/1965 | Nolf | 114/230.18 |
| 3,695,209 | A | 10/1972 | Giese | |
| 4,008,678 | A * | 2/1977 | Lawlor | 114/230.1 |
| 6,000,356 | A | 12/1999 | VanAssche et al. | |

FOREIGN PATENT DOCUMENTS

WO 81/01431 5/1981

OTHER PUBLICATIONS

International Search Report of PCT/SE2005/000527, mailed Jul. 25, 2005.

* cited by examiner

*Primary Examiner*—Jesus D Sotelo
(74) *Attorney, Agent, or Firm*—Nixon & Vanderhye P.C.

(57) ABSTRACT

Device for disembarkation on a marine structure for landing a craft that can be conveyed on the surface of water, comprising interacting landing devices arranged to the marine structure and craft respectively. The landing devices comprise a principally vertically elongated part and a contact member, respectively. The contact member is intended to partially surround part of the elongated part.

33 Claims, 7 Drawing Sheets

DEVICE FOR LANDING A CRAFT

Figure 1:
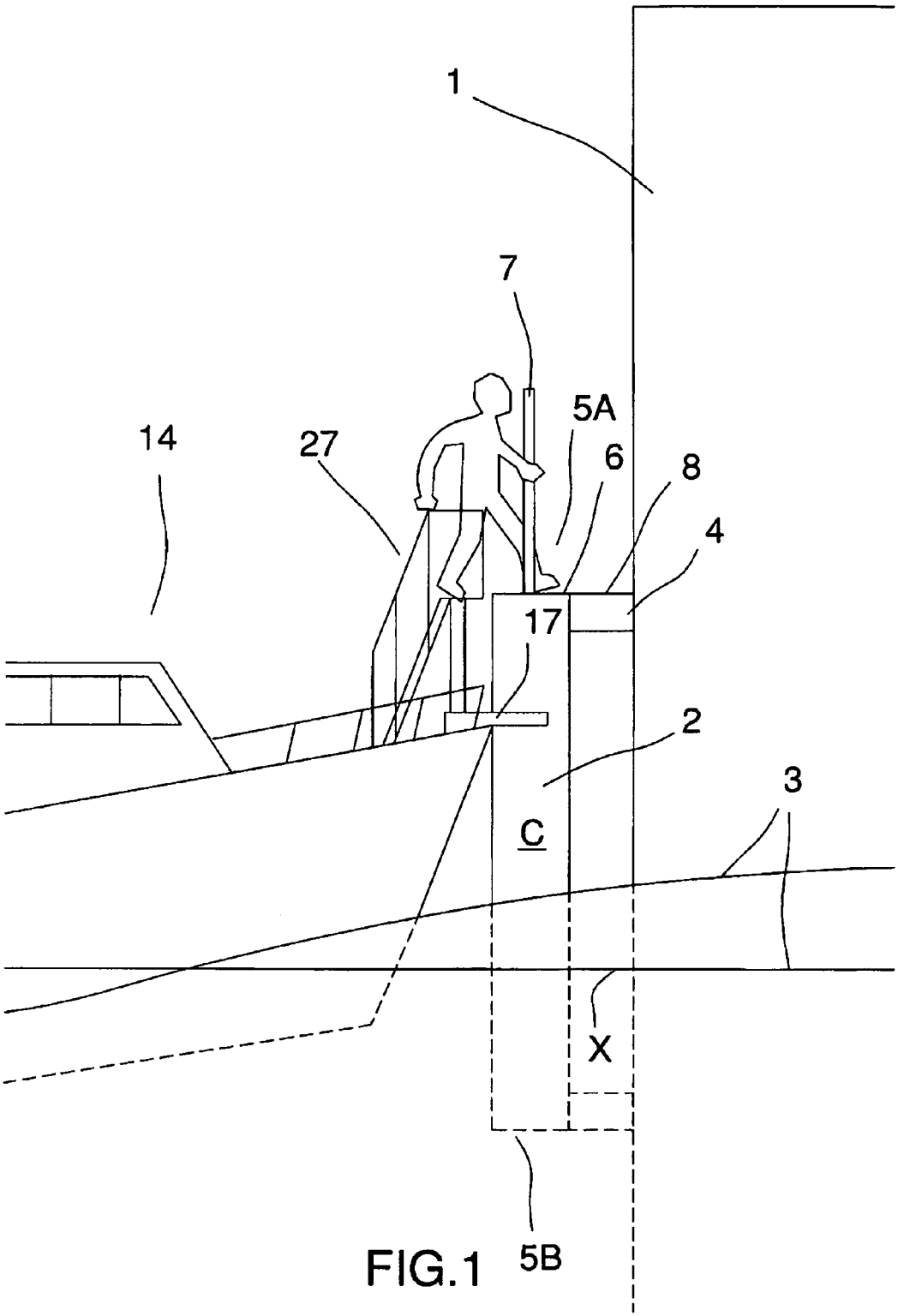

This application is the US national phase of international application PCT/SE2005/000527, filed 13 Apr. 2005, which designated the U.S. and claims priority of SE 0400999-9, filed 16 Apr. 2004, the entire contents of each of which are hereby incorporated by reference.

The present invention concerns a device for landing a craft to a marine structure.

Marine structures are a common occurrence. Examples of such are oil platforms, wind power stations, harbours and lighthouses. When landing on these structures for maintenance and repair, personnel are transported in boats. A critical point on these occasions is when the boat is landing at the marine structure and personnel are disembarking from the boat to the structure and when personnel are embarking from the structure to the boat. Landing in this respect means manoeuvring the boat to the landing device without it being moored to the same. Present devices often comprise a ladder up to a landing platform. The boat is manoeuvred to the landing and held in place for example with a rope attached to the landing. This means the boat will follow the water level while the landing is essentially fixed vertically. In heavy seas, this can cause problems during disembarkation. There is a risk of personnel disembarking being jammed between the boat and the ladder/landing.

Several proposals for devices intended to prevent injuries have been put forward. A usual method is to fasten a rope or chain between the boat and the marine structure. The disadvantage of this method is that in heavy seas, the distance between the boat and the structure will change, making disembarkation difficult. Another method often comprises a landing that is hinge mounted on the marine structure and a ladder hinge mounted to the landing platform. The disadvantage of this method is partly that the hinged mounting means personnel must climb up the ladder and walk along an inclined landing platform if the boat is above or below the level of the landing platform due to heavy seas, and partly that the boat can only land on a limited area of the device, i.e. in an area contained in the circumference of the device called the landing sector S. The hinge mountings will also mean there is a risk of crush injuries. Another disadvantage is that embarkation from the marine structure to the boat often done with the back facing the boat, i.e. personnel will embark the boat backwards. Another device comprises a pair of tubes placed on the foundation of the marine structure at a distance from each other, between which the boat is intended to be received. The disadvantage of this design is that the landing sector S is considerably limited, resulting in landing not being possible if the direction of wave propagation coincides with the intended direction of landing.

The object of the present invention is to provide a device that enables landing in a larger landing sector, reduces the risk for crush injuries and allows embarkation/disembarkation between two horizontal platforms with personnel facing the right way.

These objects of the invention can be achieved with a disembarkation and landing device that exhibits the distinctive features and characteristics specified in the claims.

One preferred embodiment chosen as an example will be described in the following with reference being made to the attached drawings, of which FIG. 1 shows a disembarkation and landing device according to the invention arranged to a watercraft and the column of a marine structure.

Figure 2:
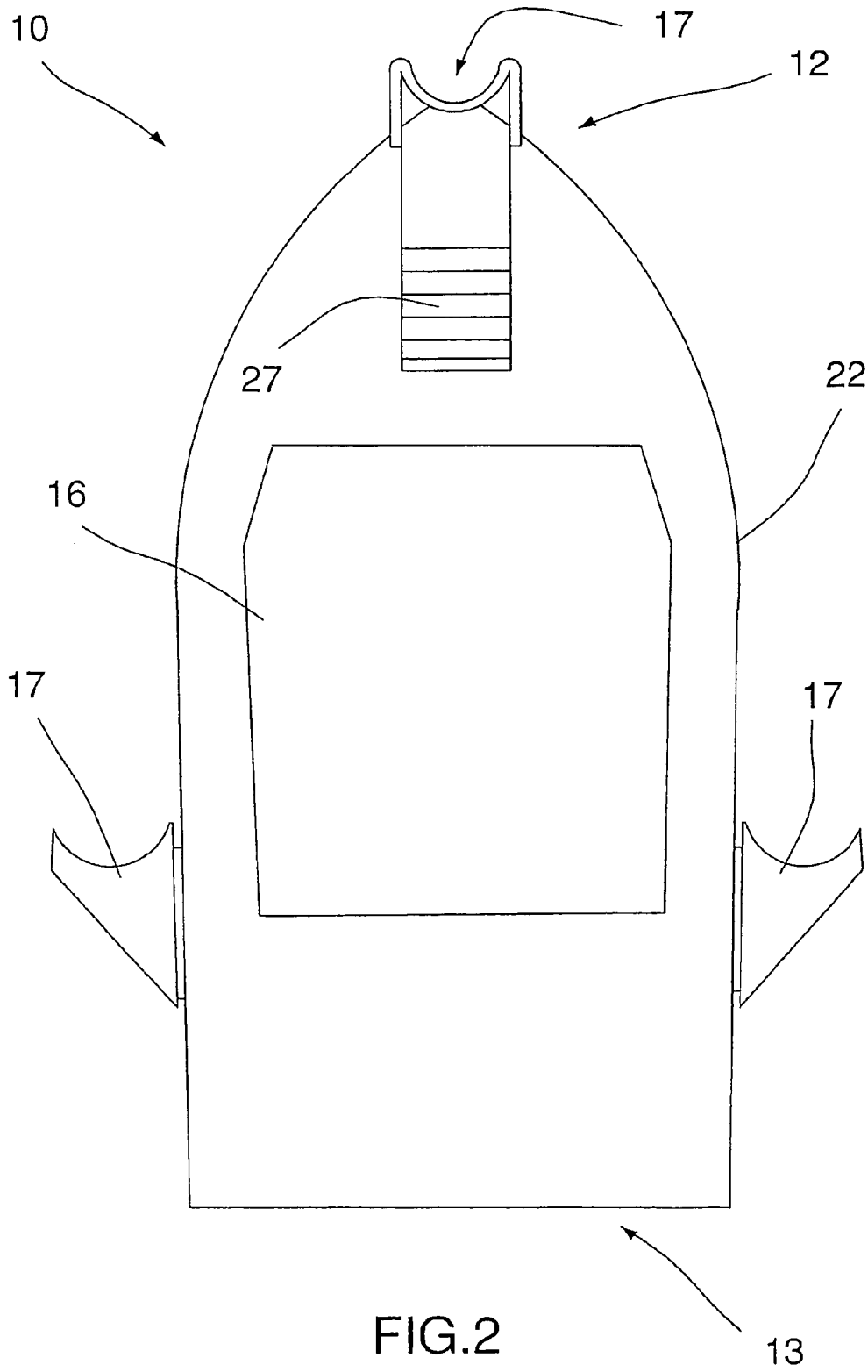
Figure 3A:
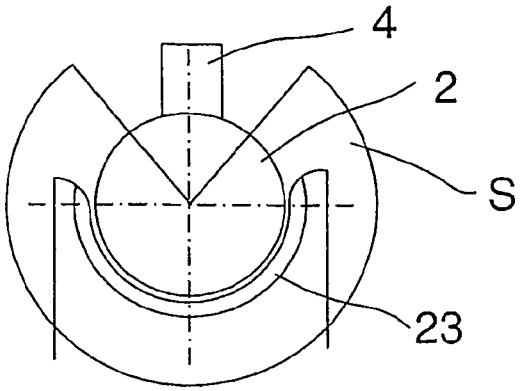
Figure 3B:
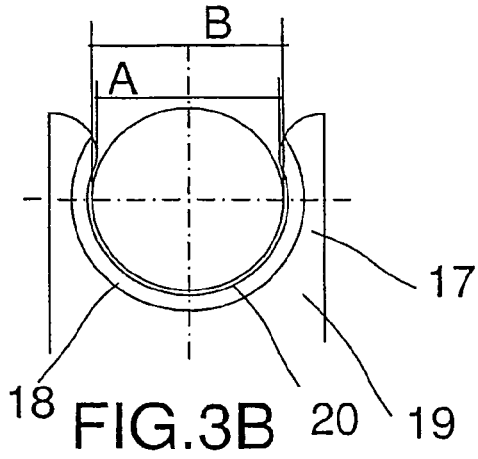
Figure 3C:
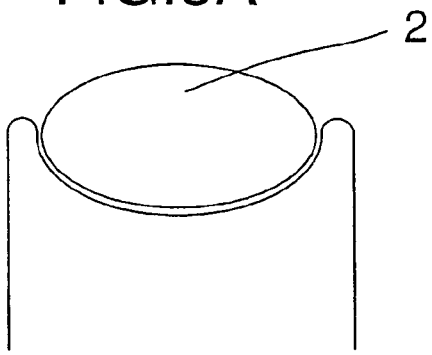
Figure 3D:
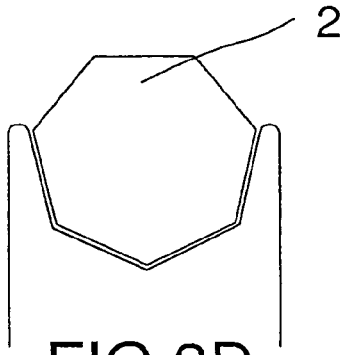
Figure 3E:
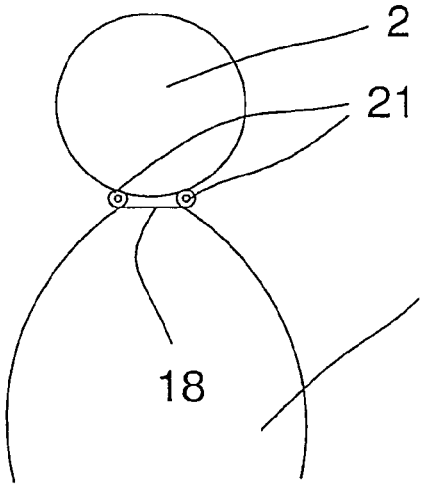
Figure 3F:
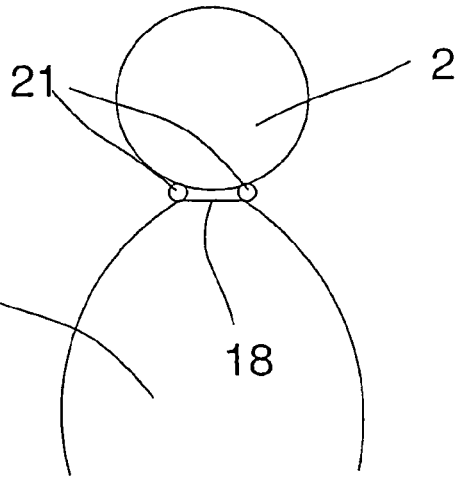
Figure 4:
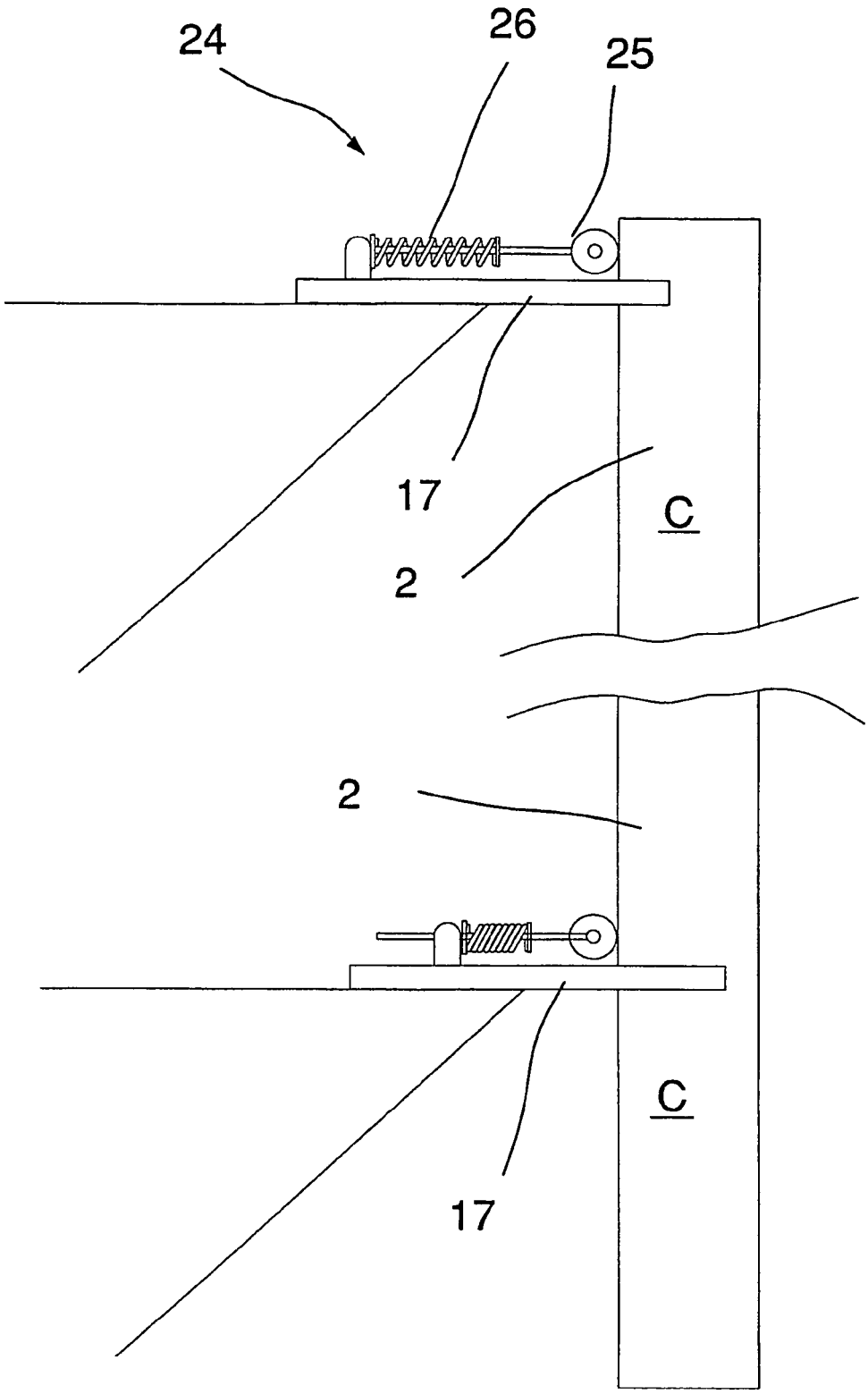
Figure 5:
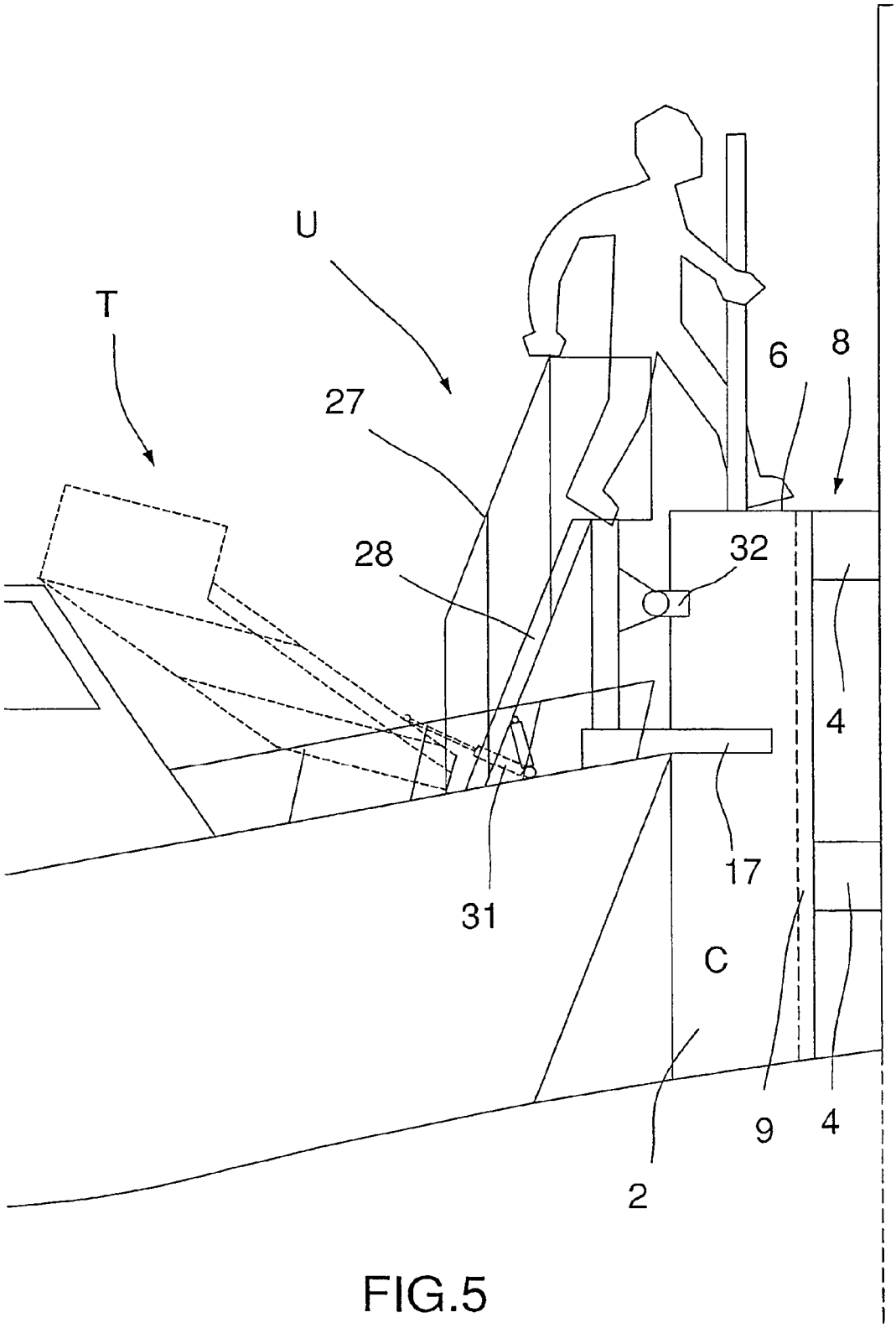
Figure 6:
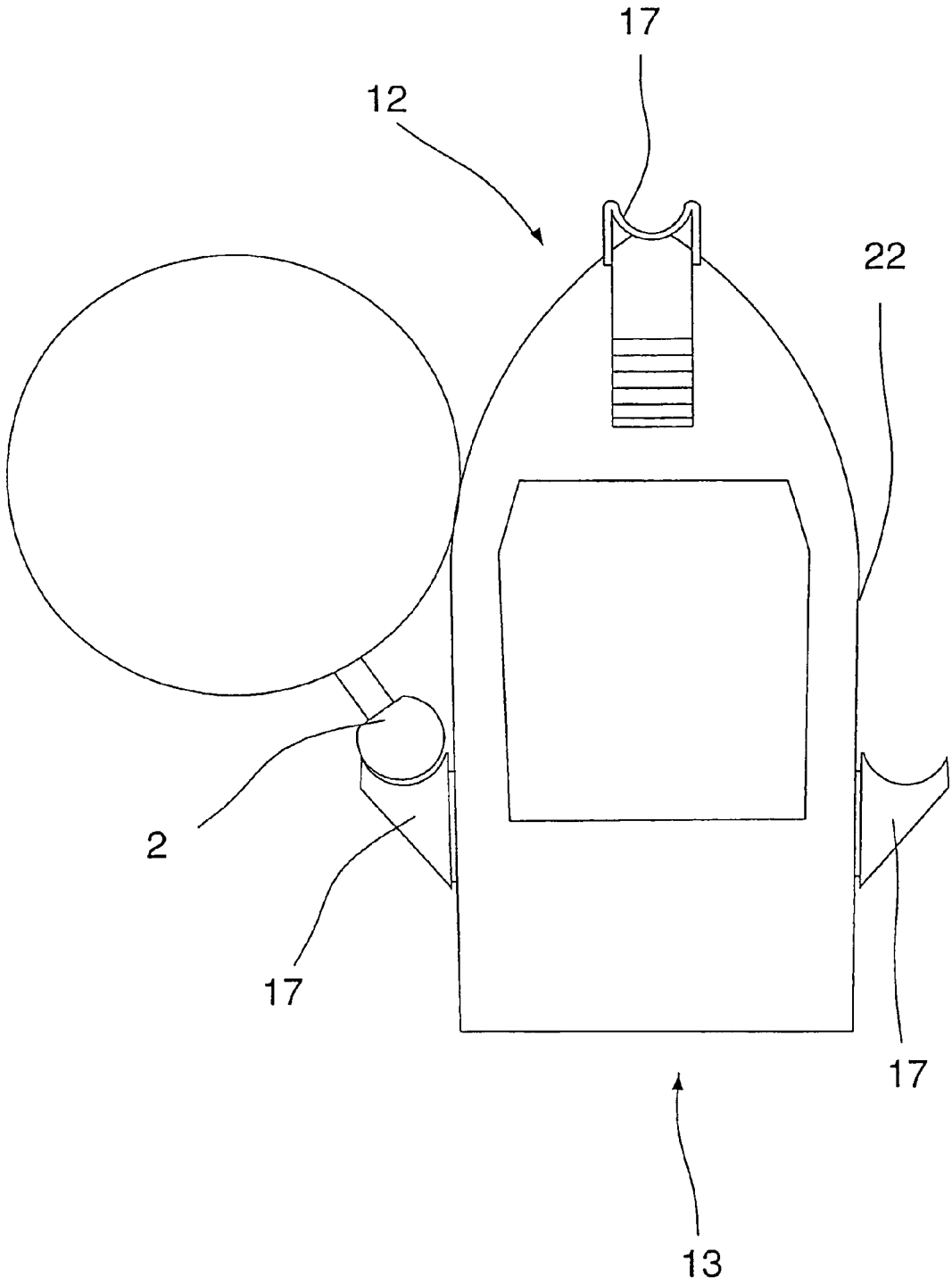
Figure 7A:
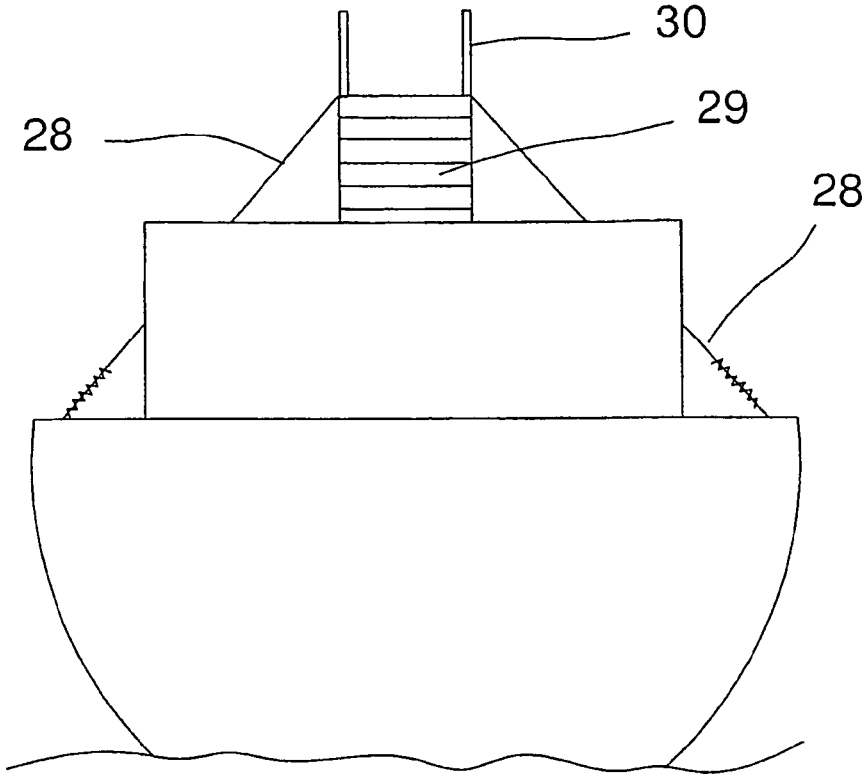
Figure 7B:
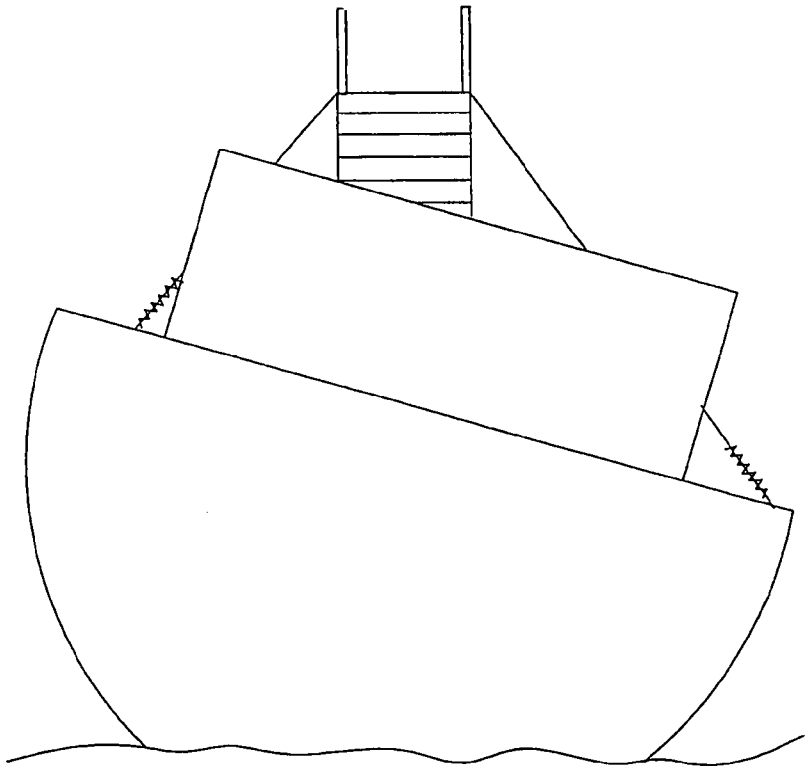

FIG. 2 shows a view from above of a watercraft arranged with several means of contact, FIG. 3A-3F shows different embodiments of the means of contact according to the invention FIG. 4 shows a view from the side of a repeller, FIG. 5 shows an embodiment of a platform arranged on the watercraft FIG. 6 shows an alternative landing method, FIG. 7A shows a view from behind of a watercraft arranged with a spring platform, and FIG. 7B shows a view of the craft in FIG. 7A while it is rolling sideways.

The marine structure according to the first embodiment comprises a wind power station located at sea. Other marine structures can comprise a jetty or a lighthouse. Such structures are often located in areas where the water is less deep, i.e. on a ground or similar. This means the waves passing the area of the ground will increase greatly in size due to the reduction in water depth. The wind power station is located on a foundation in the form of columns 1 as shown in FIG. 1, of concrete for example, on which the power station building rests. The columns 1 extend essentially vertically from the bottom of the sea and up some way above the surface of the water.

To at least one of the power station's columns 1 is arranged an upright 2 in the form of a thick-walled elongated tube with a continuous longitudinal periphery forming an area of contact C and a preferably circular cylindrical cross section. It should be understood herewith that also other tube cross sections are possible, for example oval or polygon cross sections as shown in FIG. 3C-3D. The upright 2 can also comprise a contact surface C, which forms part of an arc, i.e. contact surface C constitutes only a limited part of a circle as shown in FIG. 6. The upright 2 is so arranged to the column 1 that one end of the upright 2 is situated under the surface of the water 3, say two meters under the surface. The other end of the upright is situated above water level 3, say three meters above the said level. The surface of the water 3 is the level of the water at its mean water level (X) and in dead calm conditions. It should be understood that the distance the upright 2 extends below and above the surface of the water can be adjusted depending on the water depth and wave formation. The upright 2 is fastened to the column 1 by means of brackets 4. These brackets 4 are intended to move the upright 2 away from the column 1, whereby a greater part of the upright's 2 peripheral contact surface C is made accessible. This enables a landing sector S of approximately 180°.

To the end section 5 of the upright 2 that is above the surface of the water 3 is arranged an end piece in the form of a platform 6. The platform 6 can be made of expanded metal or other non-slip material and is intended to act as a surface onto which people disembarking from the craft can alight. To the platform 6 is arranged a grip rod 7 in the form of an essentially vertical tube extending up from the platform 6 in a direction away from the surface of the water 3. The grip rod 7 has a diameter that facilitates a person gripping around it. A catwalk 8 extends from the platform 6 to the marine structure. The catwalk 8 can be fixed to the upright 2 and the marine structure but in another embodiment can also be hinged.

The upright 2, when comprising a tube, can also be fitted with sealing end pieces to form a sealed and air-filled float. In this embodiment, the upright is mounted to slide in the attachment brackets 4, for example by means of rails 9 arranged on the upright 2 and the brackets 4 or by allowing the brackets to surround and slide on the upright. Ballast, for example sand or water, can be placed inside the air-filled space formed in the upright, whereby the upright will float in the water with a predetermined part below the surface of the water 3. This embodiment means the upright 2 will follow the changes in the level of the water 3 caused, for example, by the tide or in case of heavy seas and thereby stay at a predetermined height above the surface of the water 3.

The upright 2 can be designed so that drift ice can be prevented from reaching the marine structure columns 1. In areas with a directed movement of ice, i.e. where the principal movement of ice is in two directions, north and south for example, one upright is placed by the column that is located essentially in a northerly direction and one upright by the column located essentially in a southerly direction. The diameter of the upright in relation to the diameter of the columns means the ice drifting towards the marine structure is broken up and prevented from reaching the column.

The craft shown in FIGS. 1 and 2 comprises a boat 10 intended for the transport of passengers and materials to and from the aforesaid marine structure. It comprises in a well known manner a hull 11 with a bow 12 and stern 13, a superstructure 14, the deck and a railing 15 extending along the edge of the hull 11. The boat 10 is further provided with a helm 16 from which the boat 10 is controlled and an engine connected to a propeller, with which the boat is driven forward or backward. The hull 11 and railing 15 in the bow 12 of the boat is fitted with a contact device 17, shown in FIGS. 3A-3D, in the form of a female part 18 with recess 20 of a shape corresponding to the peripheral contact surface C of the upright 2 and is intended to surround the same. In a second embodiment, the superstructure has been extended 19 over the bow of the hull 12 in which extension the recess 20 is located.

In another embodiment as shown in FIGS. 3E-3F, the bow 12 is bevelled, i.e. has been given a straight edge essentially at right angles to the longitudinal axis of the boat. In the transition between the straight edge and the railing is arranged a guide 21 in the form of a pair of short vertical tubes or horizontal pulleys located at a distance from each other making a means of contact 17 between them. The use of the said guide 21 is also possible without the bow being bevelled or that an extension 19 is arranged from the hull 12.

According to FIGS. 2 and 6, the means of contact 17 can also be arranged in another part of the bow 12 of the boat. With the means of contact 17 located behind the centre of the boat 10, i.e. between the stern 13 and midships 22, the advantage is attained that the boat can be positioned to enable unloading, e.g. of a crane. With such a location, the boat 10 can be turned as in FIG. 6 around the upright 2 by the propeller's driving force and pressed against the marine structure column 1, whereby the boat 10 in this way can be secured with regard to rotation around the upright. The means of contact may well be arranged on both sides of the boat as shown in FIGS. 2 and 6 so that the aforesaid securement can be achieved from both directions. It should be understood that other locations for the means of contact are also possible.

The means of contact 17, in the form of a recess 20 or a pair of guides 21, is intended to receive the contact surface C of the upright 2 when the boat is landing on the marine structure. Landing in this respect means manoeuvring the boat to the upright without mooring the boat. It should be understood that the upright can also be used to tie up the boat. The female part 18 is equipped with a friction enhancing material 23, for example rubber or flexible plastic, which is partly to protect the female part 18 from wearing on the upright 2, and partly to brake the vertical movement of the boat 10 against the upright 2.

The means of contact 17 can also be designed as shown in FIG. 3*b*, whereby a wedge-like affect is obtained against the upright 2. In this case, the means of contact 17 is arranged so that it partly surrounds the upright 2 with snap-action, i.e. the distance A between the free ends of the means of contact 17 is less than the greatest dimension B of the contact surface of the upright, whereby the means of contact 17 must be forced past the greatest dimension of the upright 2 to engage with the upright 2. In conjunction with the means of contact 17 is arranged a repeller 24 in the form of a roller 25, which acts on the upright 2 when the means of contact 17 is forced in place against the upright 2. According to FIG. 4, the roller 25 is spring loaded in the longitudinal axis of the boat by means of a spring device 26, for example in the form of a powerful spiral spring, which is compressed when the means of contact 17 is forced against the upright 2. When the boat 10 is being moved away from the upright 2, the spring 26 overcomes the wedge-like action that was achieved through the design of the means of contact 17 and in this way the boat 10 is pressed away from the upright 2.

The superstructure 14 of the craft 10 is fitted with a platform 27 in conjunction with the bow of the craft 12. The platform 27 is located on legs 28 and fitted with a ladder or steps 29 for easier access to the platform 27 from the superstructure 14. The platform 27 and steps 29 have protection in the form of a railing 30, which also serves as support for personnel climbing up or down between the superstructure 14 and the platform 27. The railing 30 runs along the side of the steps 29 and platform 27 and exhibits an opening. The opening may well be located straight ahead seen in the longitudinal direction of the boat, i.e. in the same direction as the female part, but can also be located in another direction. The said opening is intended to be used as a passage for personnel to climb between the craft platform and the upright platform.

In another embodiment according to FIG. 5, the platform 27 can be moved between a transport position T and a user position U. The user position is a position in which the platform is ready to use for disembarking, i.e. essentially perpendicular. From this position, the platform can be moved, for example with the aid of one or more hydraulic cylinders 31 or by mechanical means, to an essentially lowered position T. In this lowered transport position, the platform will rest on the cabin of the boat. The platform can also be designed so that personnel can step onto the platform when it is in transport position and the platform is then operated to user position U while the personnel are standing on the platform. In a further embodiment as shown in FIGS. 7A and 7B, the platform legs are spring mounted in a longitudinal direction, i.e. have the ability to absorb lateral rolling of the boat. The part of the platform that is directed towards the bow of the boat is fitted with a guide 32 similar to the means of contact 17 used to secure the platform 27 laterally to the upright 2. This means the platform is essentially horizontal even when the boat 10 is rocking laterally as in FIG. 7B.

The device works as follows:

The craft 10, in this example a boat, is manoeuvred towards the marine structure where landing is to take place for disembarkation. The boat is manoeuvred in line against the motion of the waves, i.e. straight against the direction of wave propagation, in a direction against the column 1 to which the upright 2 is arranged. An upright 2 can well be arranged to two opposing standing columns, whereby the landing sector is doubled, i.e. 360°. Thanks to this, the boat can approach one of the uprights 2 against the motion of the waves no matter what direction that is. The boat 10 is manoeuvred with the recess 20 to rest against the upright 2. The person disembarking from the boat 10 to the marine structure stands on the boat platform 27 after climbing up the ladder or steps 29 from the boat superstructure 14. In this position, the boat 10 will follow the vertical motion of the waves, i.e. the difference in height between the boat platform 27 and the upright 2 platform 27 increases and decreases with the motion of the waves and coincides for a short time when the boat 10 platform 27 passes the upright 2 platform 6 on its way up or down.

When the platforms 6, 27 coincide vertically, a period of about 1 second, the boat driver increases engine speed whereby the recess 20 in the boat is pressed against the upright 2. The friction-enhancing material 23 arranged in the recess 20 brakes the vertical motion of the boat, i.e. the time during which the platforms 6, 27 coincide is extended. As this happens, the person can step over from the boat platform 27 to the upright platform 6, while gripping the grip rod 7 arranged on the upright platform 6, whereby this movement will take place essentially horizontally. When the person moves to the upright platform 6, the person will be a distance away from the boat 10, thereby eliminating the risk of getting crushed or injured in another way by the vertical motion of the boat 10. Once the person is in safety on the upright platform 6, the boat driver can reduce engine speed so that the means of contact 17 grip on the upright 2 ceases and the boat 10 is pressed away from the upright 2 by the force of the spring roller 25 in preparation for the next person to disembark, which is also performed in the aforesaid manner.

When a person is moving from the marine structure to the boat, this is done in the reverse order. The person is standing on the upright platform 6 waiting for the point in time when the upright platform 6 and the boat platform 27 coincide vertically. When the platforms 6, 27 coincide vertically, the driver increases engine speed to press the friction enhancing material 23 in the recess against the upright 2 to brake the vertical motion of the boat 10. At the point in time when the platforms 6, 27 coincide vertically, the person can step from the upright platform 6 to the boat platform 27 facing the right way, i.e. facing the boat and not forced to back into the boat. At the same time as the person steps onto the boat platform 6, the person will be at a distance from the upright 2, eliminating the risk of crush injuries.

In the embodiment described with an air-filled upright slide mounted with slide rails to the column, this advantage is achieved with the distance between the upright platform and the average water level being essentially constant irrespective of tide or swell. A further advantage is that the time during which the upright platform and the boat platform are at the same height is extended as the upright follows the waves in the same manner as the boat, so that a person embarking or disembarking the boat can do so in a safer manner over a longer period.

In another embodiment, the means of contact can be used for landing the boat to another watercraft. The object of this embodiment is to be able to board another watercraft in a safe manner or give the possibility of providing help transport to another craft that, for example, is in distress by pushing the craft to a protected place.

The present invention is not limited to the above description and as illustrated in the drawings but can be changed and modified in a number of different ways within the framework of the idea of invention specified in the following claims.

The invention claimed is:

1. A device for disembarkation on a marine structure for landing but not mooring a craft that can be conveyed on the surface of water, comprising interacting landing devices arranged on the marine structure and craft respectively, wherein the landing devices comprise a principally vertically elongated part and a means for contacting the vertically elongated part when the craft is maneuvered in its longitudinal direction against the elongated part, respectively, the means for contacting after landing only partially surrounding part of the elongated part.

2. The device according to claim 1, whereby the elongated part has a convex shape and is continuous in a longitudinal direction.

3. The device according to claim 1, wherein the elongated part is arranged on the marine structure.

4. The device according to claim 1, wherein the means for contacting is arranged on part of the craft.

5. The device according to claim 1, wherein the means for contacting has a concave shape.

6. The device according to claim 1, wherein the elongated part comprises an upright with first and second end sections of which the first end section is structured to be arranged above the surface of the water and the second end section is structured to be arranged below the surface of the water.

7. The device according to claim 6, wherein the upright comprises a contact surface that can be surrounded by the means for contacting in an area around the upright constituting a sector of a circle.

8. The device according to claim 6, wherein the upright is essentially circular cylindrical.

9. The device according to claim 6, wherein the upright is arranged at a distance from the marine structure.

10. The device according to claim 6, further comprising one or more brackets to fix the upright to the marine structure.

11. The device according to claim 6, further comprising at least one of a bracket and slide rails to slidably mount the upright to the marine structure.

12. The device according to claim 6, wherein the first end section of the upright is arranged with a platform.

13. The device according to claim 6, whereby the upright is watertight and filled with air.

14. The device according to claim 12, whereby the platform is connected to a float arranged on the upright.

15. The device according to claim 1, wherein the craft is arranged with a platform.

16. The device according to claim 15, wherein the platform can be moved between a transport position and a user position.

17. The device according to claim 12, wherein the platform of the craft is essentially the same height as a platform of the elongated part when a water surface of varying height is at its mean level.

18. The device according to claim 1, wherein the means for contacting comprises a recess arranged in a part that is structured to protrude outside the craft.

19. The device according to claim 1, wherein the means for contacting is arranged with a friction enhancing material.

20. The device according to claim 1, wherein the means for contacting surrounds the upright with snap fastening.

21. The device according to claim 1, wherein the means for contacting is equipped with a repeller.

22. The device according to claim 1 wherein the means for contacting is arranged in conjunction with the bow of the craft.

23. The device according to claim 1, wherein the means for contacting is structured to be arranged between the bow and the stern.

24. The device according to claim 1, wherein the means for contacting is structured to be arranged between the bow and the stern on each side of the craft.

25. A device for disembarkation on a marine structure for landing but not mooring a craft that is conveyable on a surface of water, comprising a first interacting landing device for the craft that is engageable with a second interacting landing device for the marine structure, wherein the first interacting landing device is structured to only partially surround the second interacting landing device even after landing, and wherein the second interacting landing device defines a landing sector to enable the first interacting landing device to engage the second interacting landing device over a wide range of angular positions.

26. A device according to claim 25, wherein the range is approximately 180°.

27. The device according to claim 25, wherein the first interacting device is provided with a friction enhancing material.

28. The device according to claim 25, wherein the first interactive device is equipped with a repeller.

29. A watercraft comprising:

a hull defining a bow and a stem; and the device of claim 25.

30. The watercraft according to claim 29, wherein the first interacting structure comprises a recess arranged in a part that protrudes outside the craft.

31. The watercraft according to claim 29, wherein the first interacting device is arranged in conjunction with the bow of the craft.

32. The watercraft according to claim 29, whereby the first interacting device is arranged between the bow and the stern.

33. The watercraft according to claim 29, wherein the first interacting device is arranged between the bow and the stern on each long side of the craft.

* * * * *